United States Patent [19]

Ryall

[11] Patent Number: 4,707,308

[45] Date of Patent: Nov. 17, 1987

[54] APPARATUS FOR CIRCULATING WATER

[76] Inventor: Ronald W. Ryall, 673 Ascot St., Vista, Calif. 92083

[21] Appl. No.: 554,955

[22] Filed: Nov. 28, 1983

[51] Int. Cl.[4] ..... B01F 3/04

[52] U.S. Cl. ..... 261/77; 210/221.2; 261/123; 261/DIG. 75

[58] Field of Search ..... 261/76, 77, 123, DIG. 75; 119/3, 5; 210/169, 221.2; 209/170; 43/56, 57

[56] References Cited

U.S. PATENT DOCUMENTS

| | | | |
|---|---|---|---|
| 2,479,403 | 8/1949 | Powers | 261/DIG. 75 |
| 3,282,227 | 11/1966 | Nielsen | 261/DIG. 75 |
| 3,722,679 | 3/1973 | Logue | 261/DIG. 75 |
| 3,780,997 | 12/1973 | Hargraves | 261/DIG. 75 |
| 3,829,070 | 8/1974 | Reba et al. | 261/77 |
| 3,931,370 | 1/1976 | Murphy | 261/77 |
| 3,938,738 | 2/1976 | Nagel et al. | 261/DIG. 75 |
| 3,968,086 | 7/1976 | Romanowski | 261/77 |
| 3,984,323 | 10/1976 | Evens | 261/DIG. 75 |
| 4,210,613 | 7/1980 | Webb | 261/77 X |

FOREIGN PATENT DOCUMENTS

| | | | |
|---|---|---|---|
| 146554 | 2/1981 | Fed. Rep. of Germany | 261/77 |

*Primary Examiner*—Richard L. Chiesa
*Attorney, Agent, or Firm*—John J. Connors

[57] ABSTRACT

Disclosed is a device for circulating water within a body of water including an inductor and an aspirator disposed inside the inductor. The inductor is partially submerged in the body of water and it has a restricted segment between two open ends. The aspirator is disclosed below the restricted segment in a predetermined position to provide enhanced circulation of water. Specifically, the aspirator provides a cone which fills the restricted segment with a mixture of air and water and the aspirator is positioned relative to the restricted segment so that the point where the cone begins to break apart is at or near this restricted segment.

6 Claims, 4 Drawing Figures

APPARATUS FOR CIRCULATING WATER

BACKGROUND OF THE INVENTION

1. Field of the Invention

This invention relates to apparatus for circulating water within a large body of water. Specifically, it relates to apparatus which amplifies the flow of a pump which ordinarily operates efficiently at a high head of water, enabling the pump to operate at a low head of water at high efficiency.

2. Background Discussion

In sewage treatment, fish farming, and other industrial applications, it is necessary to aerate and circulate a body of water. The reason is to introduce sufficient quantities of oxygen into the water so that it will not become stagnant. Depending upon the size of the body of water, different types of pumps are employed to circulate water, moving water from the lower regions to the surface. In general, however, the pumps commonly employed are designed to operate at a high head of water. In other words, in order for the pump to operate efficiently, the load on the pump must be high. For example, typically a 5 horsepower (HP) pump of conventional design will require a head of 25 feet of water in order to operate at an efficiency of 60%. Pumps used for these applications are not designed to operate at low loads or low heads of water.

In many applications, aeration can be accomplished by simply circulating the body of water, taking the water from the lower depths and moving this water to the surface. Such circulation does not require a high or large head. Typically, if the water is pumped from six inches to two feet above the surface of the water, this is sufficient to accomplish the desired circulation. The problem is that this cannot be accomplished efficiently using conventional pumps. The inefficient operation of the pump results in the waste of large quantities of electrical energy. This contributes substantially to the cost of aeration and, in many instances, makes it economically unfeasible to aerate certain bodies of water using conventional pumps.

BRIEF DESCRIPTION OF THE INVENTION

I have invented apparatus for circulating water in a large body of water which amplifies the rate at which a conventional pump will pump water from the lower portions of the body of water to its surface. It accomplishes this in an energy-efficient manner so that a substantial savings in electrical energy is accomplished. The apparatus of this invention, therefore, enables one to aerate a large body of water in a cost-effective way which has hitherto been impossible to accomplish.

This apparatus has two principal components, an inductor and an aspirator. The inductor is in its simplist form a pipe or the like which provides a channel for fluid to flow into the inlet out the outlet. Preferably the inductor has between the inlet and outlet a restricted segment. The use of such a restriction increases the efficiency of the pump, for example, by as much as 15%. The internal walls of the inductor are generally smooth and curve inwardly towards the restricted segment. The inductor is partially submerged in the body of water, with the inlet below the surface of the water and the outlet at the surface of the water. The aspirator is disposed in the inductor below the restricted segment. The aspirator has a water inlet in communication with the body of water, an air inlet in communication with the atmosphere, and an outlet which directs a mixture of air and water enanating therefrom upwardly towards the restricted segment. The mixture of air and water is in the form of a confined cone which, at a predetermined point from the outlet of the aspirator, begins to break apart. The aspirator is positioned in the inductor relative to the restricted segment so that the point where the cone begins to break apart is at or near the restricted segment. The cross-sectional area of the restricted section is approximately equal to the cross-sectional area of the cone taken at a right angle to the longitudinal axis of the cone at the point where the cone begins to break apart. Alternatively, more than one aspirator could be used.

The apparatus is operatively connected to a conventional pump which pumps water into a chamber which is disposed below the aspirator and is in communication with the water inlet of the aspirator. Typically, the pump operates against a back pressure of 50 to 125 feet of water. The pump forces water through the chamber and into the inlet of the aspirator and out its outlet. This creates a suction which pulls air into the aspirator mixing the air and water flowing through the aspirator to generate the cone. This mixture of air and water partially filling the inductor is substantially less dense than the water surrounding the inductor. Consequently, the water surrounding the inductor pushes water into the inlet of the inductor, forcing water to flow upwardly through the inductor simultaneously with the pumping of water into the aspirator. This, in effect, multiplies the pumping capability of the pump. The pump produces a head of water above the surface of the body of water a height of from about 3 to about 24 inches.

BRIEF DESCRIPTION OF THE DRAWING

The apparatus of this invention will be better understood by considering the following detailed description taken along with the following drawing in which like numerals indicate like parts. In the drawing.

DETAILED DESCRIPTION OF THE DRAWING

Figure 1:
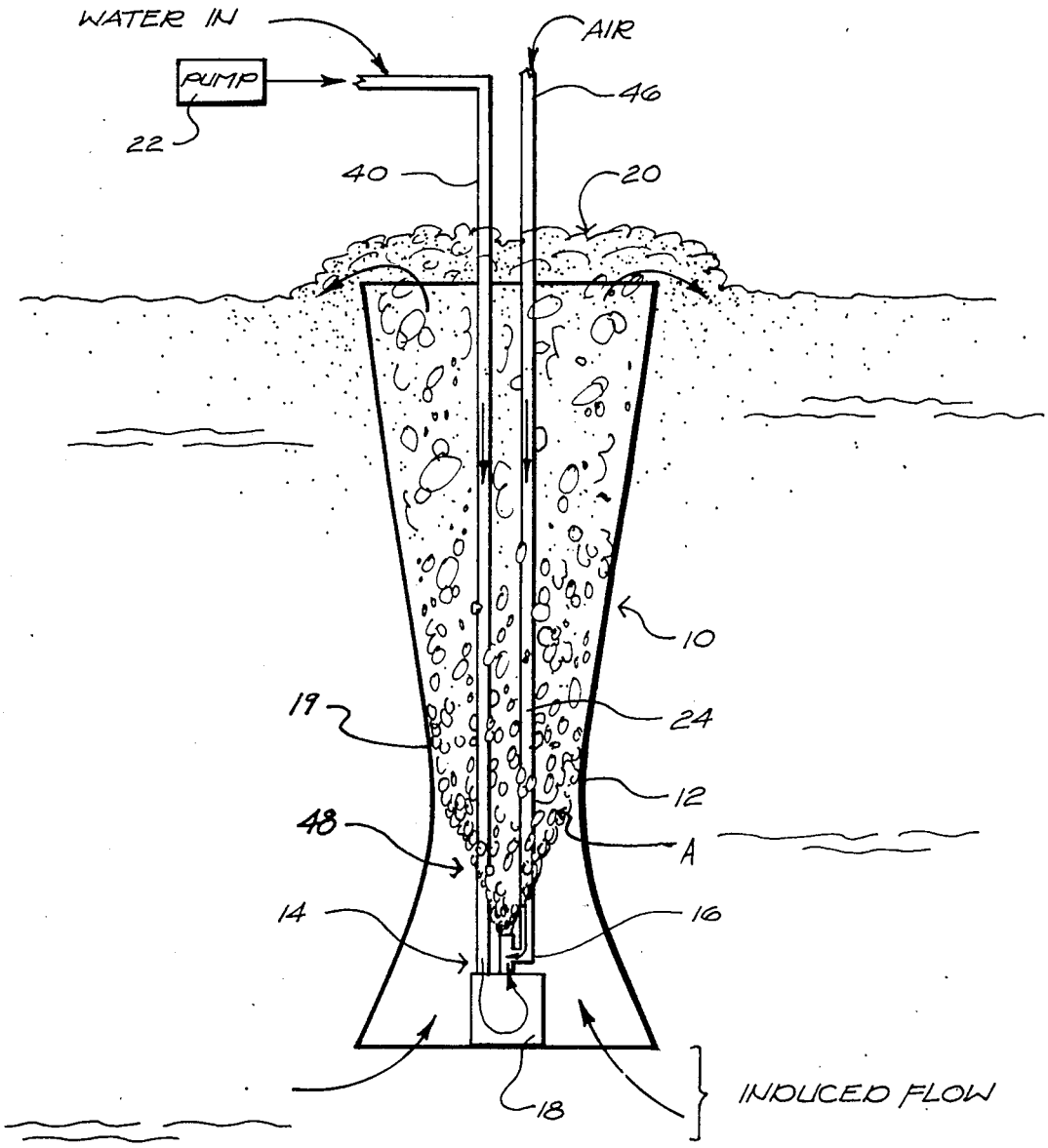
FIG. 1 is a schematic view of the apparatus of this invention.
Figure 2:
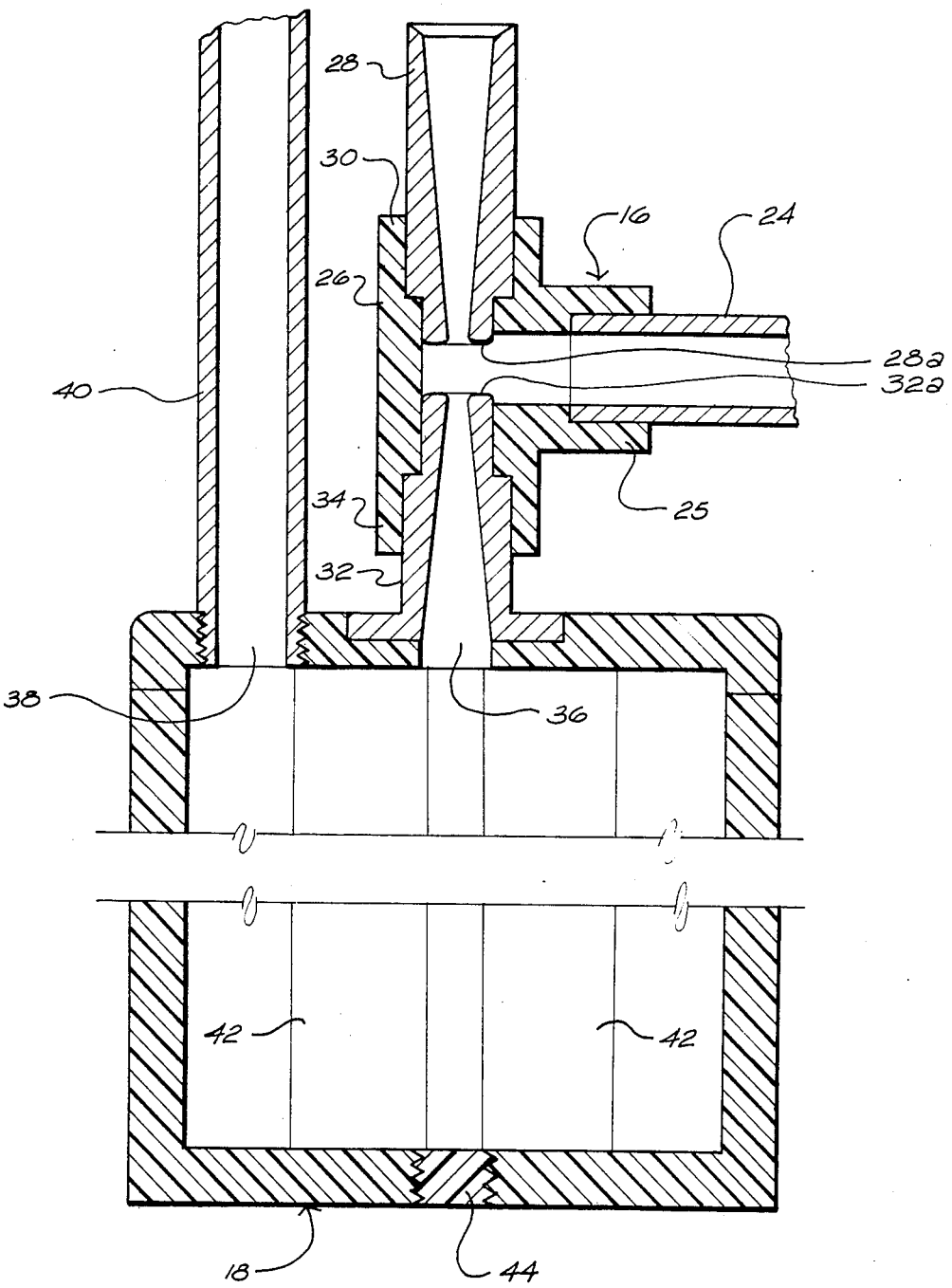
FIG. 2 is an enlarged cross-sectional view of the plenum chamber and aspirator used in the apparatus of this invention.
Figure 3:
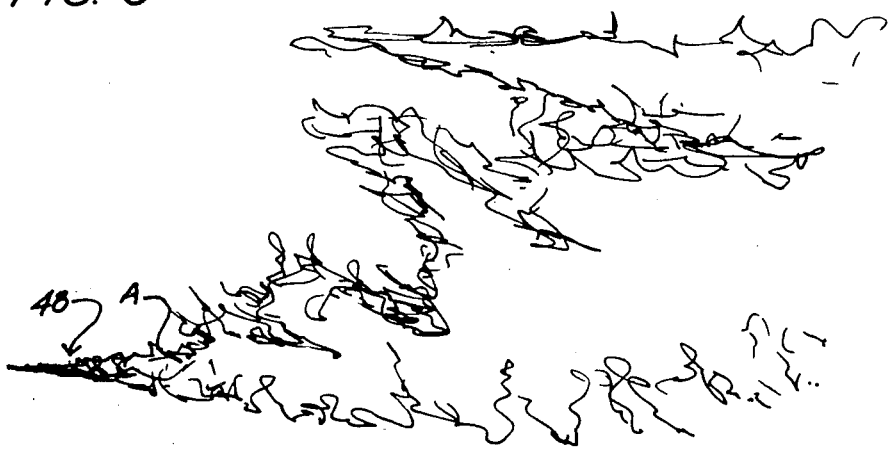
FIG. 3 is a schematic view of the cone of air and water emanating from the aspirator.

As shown in FIGS. 1 through 3, the apparatus (10) of this invention includes an inductor (12) and an ejector (14), including an aspirator (16) and plenum chamber (18).

Inductors are conventional devices which are used throughout industry for controlling the flow of fluids, particularly gases. The inductor (12) is basically a tubular member having a restricted segment (19) near its lower end. This lower end of the inductor (12) is submerged well below the surface of the body of water in which the apparatus is disposed. The upper end of the inductor (12) is at the surface of the water. Typically it will extend a few inches above the water surface, generally 3 to 24 inches. As water flows through the inductor (12) it spills over the outlet end creating a head (20) of water between six inches and two feet. The height of the head (20) of water will depend on the design of the inductor (12) and the ejector (14) and the pump (22) being used to pump water through the apparatus. As mentioned above, the apparatus (10) of this invention operates at a low head of water with pumps that are ordinarily inefficient when operating at such low heads.

As best shown in FIG. 2, the aspirator (16) comprises an air inlet tube (24) which has an outlet end connected to the stem (25) of a T-joint (26).

A diffusor (28) is connected to the outlet end (30) of the T-joint (26) and a nozzle (32) extends outwardly from the inlet end (34) of the T-joint. This nozzle (32) is aligned with an opening (36) in the plenum chamber (18) and is secured to the top of plenum chamber. The diffusor difuser (28) and nozzle (32) each have a passage therein which increases in diameter, with the diffusor and nozzle being positioned so that the passageways are aligned with the ends 28*a* and 32*a* of the passageways of smallest diameters being adjacent each other but spaced apart. These ends 28*a* and 32*a* are referred to herein as orifices. As will be explained in detail below, the orifices 28*a* and 32*a* are carefully selected to maximize efficiently of operation.

This arrangement of the diffusor difuser (28) and nozzle (32), with the end of the air inlet tube positioned so that air is drawn into the water as it flows from the nozzle into the difuser, provides, in effect, a restriction in the stream of flowing water between the nozzle (32) and difuser (28). When water flows through the aspirator (16) upwardly, its velocity increases as it approaches the restriction. This will create a drop in pressure at this point.

A water inlet opening (38) is connected or in communication with the plenum chamber (18) into which water is pumped by the pump (22) through a conduit (40) extending from the outlet of the pump into the top of the plenum chamber. Within the chamber are a series of baffles (42) which distribute the water flowing into the plenum chamber directing it out the opening (36) into the aspirator (16). The chamber is closed at the bottom so only water being pumped by the pump (22) flows through the chamber into the aspirator (16). A removable plug (44) is provided for draining the chamber (18) during cleaning.

Air is introduced into the aspirator (16) via the air inlet tube (24) which extends along the inside of the inductor (12) having its one end (46) above the water's surface in communication with the atmosphere. As water is pumped into the plenum chamber (18) and through the aspirator (16), suction is created which draws air into the water flowing from the nozzle 32 into the diffuser 28. This air mixes with the water flowing through the aspirator to create a column of an air/water mixture which emanates from the outlet of the aspirator as a cone (48). This cone (48) is shown in FIG. 3.

The characteristic feature of this cone is that at a predetermined distance from the outlet of the aspirator, the cone begins to break apart. As shown in FIG. 3 this breakup occurs at point A. In accordance with this invention, the position of the ejector (14) relative to the restricted segment (19) in the inductor (12) is such that the aspirator (16) is positioned so that the point where the cone begins to break apart, point A, is at or near the restricted segment in the inductor.

The forces generated by the water flowing through the ejector (14) and inductor (12) are such that an equilibrium is established. The apparatus (10) is shown so that the inductor (12) is not connected but is able to freely float in the water relative to the injector (14). When the pump (22) is turned on to force water through the aspirator (16), this draws water into the bottom of the inductor (12) at the same time that the air/water mixture emanates from the aspirator (16). The column of water above the aspirator (16) and the drag forces associated with the various components of the apparatus (10) are balanced against the flow of water and air upwardly through the inductor (12) so that the inductor will ordinarily assume the correct position relative to the restricted segment (19). That is, it will normally assume a position where the restricted segment is adjacent the break point A in the cone (48) of the air/water mixture emanating from the aspirator (16).

In many instances it is desirable to achieve maximum circulation of water through the apparatus (10). This is accomplished using an inductor having a restricted segment and by correctly designing the aspirator. Specifically, the diameters (d) of the orifices are adjusted so that the desired optimization is accomplished. The following equation is used in calculating the correct orifice diameter.

$$d^2 = \frac{Q}{18.64} \sqrt{h}$$

Where d is the diameter of the smallest opening in the end of the nozzle in inches.

Q is the quantity of water flowing through the pump in gallons per minute.

h is the height of the head in feet.

Figure 4:
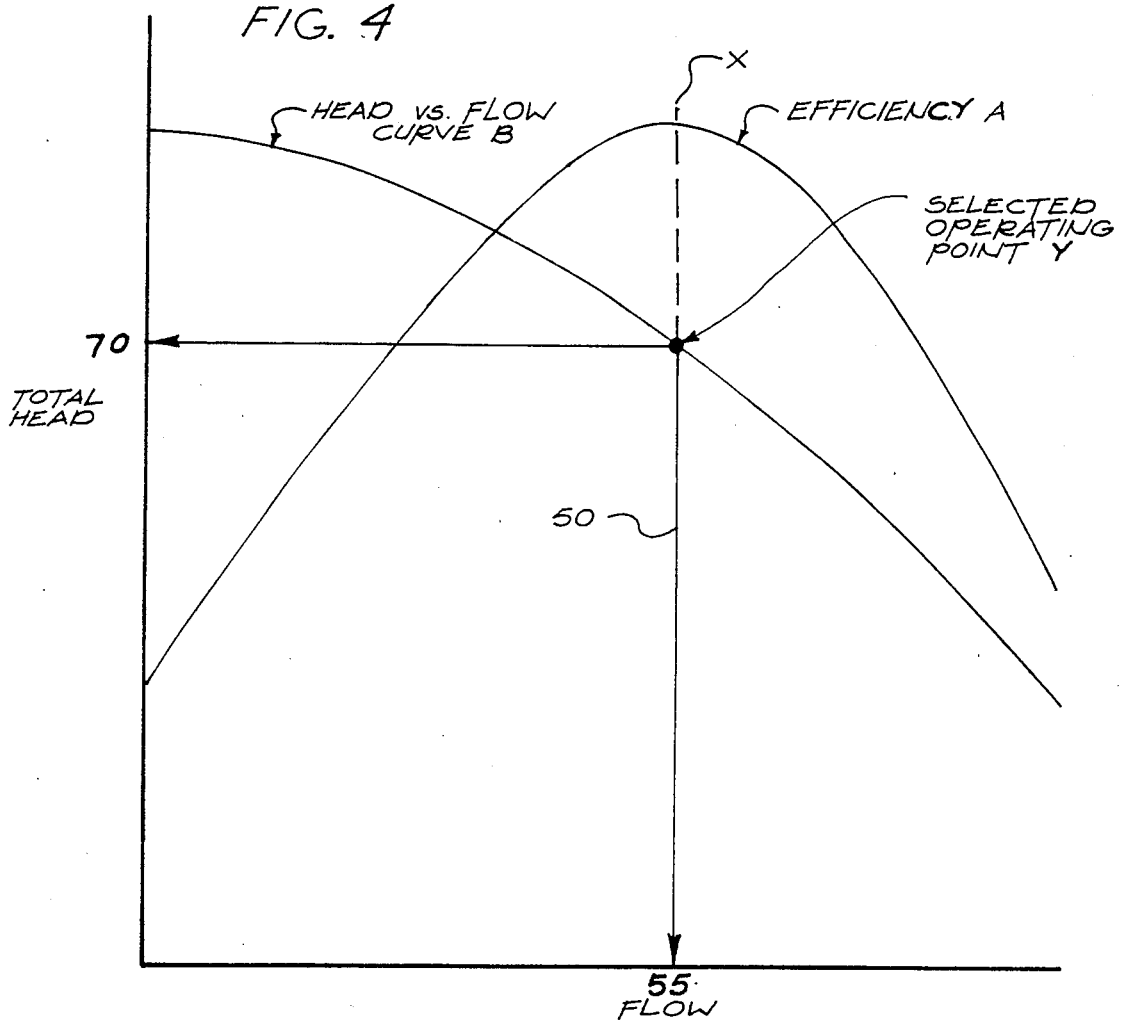
FIG. 4 is a graph showing the efficiency curve (A) of the pump used with the apparatus of this invention and the head verses flow curve (B) of this pump.

First refer to the efficiency and head vs flow curves for the pump to be used, for example, curves A and B shown in FIG. 4. Curve A is used to select the most efficient operating conditions for the pump which is at the peak, point X. For this pump it operates most efficiently at gallons (Q) per minute. This line 50 intersects curve B at point Y, which corresponds to 70 feet of head (h). Using the above equation, the correct orifice diameter is calculated as follows:

$$d^2 = \frac{55}{18.64} \sqrt{70}$$

$$d^2 = 0.3532$$

$$d = 0.59 \text{ inch}$$

OPERATION

The apparatus (10) of this invention operates as follows: First the pump (22) is turned on to pump water through the conduit 40 into the plenum chamber (18). The pressure of the water in the plenum chamber (18) forces water into the aspirator (16). This water flows through the aspirator (16) and out the difuser (28). This creates a suction which draws air into the aspirator through the air inlet tube (24) and into the stream of water flowing through the aspirator. The air/water mixture emanating from the aspirator forms the cone (48) which begins to break apart at point A adjacent the restricted segment (19) in the inductor (12).

Because the density of fluid in the inductor (12) is substantially less than the water surrounding the inductor, water will flow into the open bottom of the inductor at a very rapid rate. This water is drawn through the inductor (12) and mixes with the air/water mixture from the aspirator (16). This churning mass of air and water bubbles over the top of the inductor (12) to form a low head (20) of water which spills over the rim of the inductor. Thus, there is a flow outwardly from the top of the inductor in a radial fashion along the surface of the body of water. Simultaneously, water from the lower portions of the body of water flow into the bottom of the inductor (12) and move upwardly to the surface. This is a highly desirable condition which draws water deficient in air from the lower stratas into the inductor (12), moving them to the surface where they are mixed with air. This is accomplished in an efficient manner, providing a substantial cost savings in energy.

The apparatus of this invention has been compared with typical circulating apparatus used for such applications as airlift, mixing and circulation. The following table presents the comparisons:

TABLE I

| | AIRLIFT APPLICATIONS | |
|---|---|---|
| | Apparatus 10 | Air Pump and Airlift |
| Flow/HP | 3 ft, 1400 gpm* | 1000 gpm |
| | 5 ft, 1400 gpm | 800 gpm |
| | 10 ft, 1400 gpm | 100 gpm |

| | AERATION APPLICATIONS (lbs/HP/Hr) | |
|---|---|---|
| | Apparatus 10 in dirty water | Air Pump in clean water |
| lbs $O_2$/HP Hr at 5 ft | 45 | 47 |
| lbs $O_2$/HP Hr at 10 ft | 45 | 30 |

| | MIXING | |
|---|---|---|
| | Apparatus 10 | Pentec** Pump |
| gpm/HP | over 1000 | 167 advertising |
| | 2 minutes to mix | 4 minutes to mix |
| | 2000 gpm with 1 HP | 2000 gal with 3 HP |

| | CIRCULATION ONLY (gpm/HP MAXIMUM) | |
|---|---|---|
| | Apparatus 10 | Berkeley Propeller Pump |
| gpm/HP | 1000–2500 | 500 |

*gallons per minute.
**Pentec pump not used for circulation - used in cell or tank mixing only.

When the apparatus (10) is used as an airlift, it can be operated at substantially any depth and still maintain a high level of circulation, pumping 1400 gallons per minute regardless of the depth, compared with the prior art air pump airlift which decreases in its rate of circulation as the depth increases. For aeration applications it maintains a relatively high level regardless of depth. For mixing applications it will pump over 1000 gallons per minute. This is substantially more than the prior art, which pumps substantially less than this with a much higher horespower pump. Mixing is to be distinguished from circulation in that it is carried out in a relatively confined zone such as a tank. Circulation refers to the type of application as discussed above where one is moving water from the lower portions of a pond up to the surface.

Currently there are no pumps commercially available which are suited for circulating water in, for example, fish farm ponds efficiently at a low head. A typical fish farm will employ airlift type pumps. The recommended horsepower on a per acre basis is 5 HP per acre. We can accomplish the same aeration with a pump rated at 1.5 HP. The cost savings is approximately 60%. This will make it economical to employ aeration in many fish farming applications where it would be too costly otherwise.

The above description presents the best mode contemplated for carrying out the present invention. This invention is, however, susceptible to modifications and alternate constructions from the embodiments shown in the drawing and described above. It is not the intention to limit this invention to the particular embodiment disclosed; but on the contrary, the invention is to cover all modifications, equivalencies, and alternative constructions falling within the spirit and scope of the invention as expressed in the appended claims.

What is claimed is:

1. Apparatus for circulating water within a body of water, comprising:

inductor means having an inlet and an outlet and wall means defining between said inlet and outlet a restricted segment, said inductor means being submerged in the body of the water with the inlet below the surface of the water; aspirator means disposed below the restricted segment at the inlet of the inductor means and centrally positioned and spaced from the wall means, said aspirator means having a water inlet, a gas inlet in communication with the atmosphere, and an outlet, said water inlet, air inlet, and outlet of the aspirator means being disposed below the restricted segment, pump means connected to the water inlet of the aspirator means for pumping water from the body of water into the aspirator means through said water inlet, so air is drawn into the air inlet and a mixture of atmospheric gas and water flows from the aspirator outlet upwardly towards the restricted segment, with said mixture of atmospheric gas and water being in the form of a confined cone which at a predetermined point from the outlet of the aspirator means begins to break apart; said aspirator means being positioned relative to the restricted segment so that the point where the cone begins to break apart is at or near the restricted segment, and the cross-sectional area of the cone taken at a right angle through the longitudinal axis of the cone at the point where the cone begins to break apart approximately equals the cross-sectional area of the restricted segment.

2. The apparatus of claim 1 wherein a plurality of aspirator means are used.

3. The apparatus of claim 2 where the cross-sectional area of the cones when a plurality of aspirators are used, taken at a right angle through the longitudinal axis of the cones at the point where the cones begin to break apart, approximately equals the cross-sectional area of the restricted segment.

4. The apparatus of claim 3 including pump means which pumps water through the aspirator means at a pressure which induces flow of water through the inductor means and out the outlet to provide a head of water above the surface of the body of water a height of from about 3 to about 24 inches.

5. The apparatus of claim 4 wherein the pump means operates against a back pressure ranging between about 50 to 125 feet of water.

6. The apparatus of claim 1 wherein the aspirator means is designed to maximize the efficiency of the pump.

* * * * *